US007449072B1

(12) United States Patent
Johnson et al.

(10) Patent No.: US 7,449,072 B1
(45) Date of Patent: Nov. 11, 2008

(54) ULTRASONIC REMOVAL OF MATERIALS FROM CONTAINERS

(75) Inventors: Randal Johnson, Albuquerque, NM (US); Catherine Malins, Albuquerque, NM (US)

(73) Assignee: TPL, Inc., Albuquerque, NM (US)

( * ) Notice: Subject to any disclaimer, the term of this patent is extended or adjusted under 35 U.S.C. 154(b) by 27 days.

(21) Appl. No.: 11/458,971

(22) Filed: Jul. 20, 2006

(51) Int. Cl.
*B08B 3/12* (2006.01)

(52) U.S. Cl. ..... 134/1; 134/22.1; 134/22.11; 134/22.14; 134/22.19; 134/42; 134/166 R; 134/166 C; 241/1; 86/50

(58) Field of Classification Search ..... 86/50; 134/1, 22.1, 22.11, 166 R, 166 C, 22.14, 134/22.19, 42; 241/1
See application file for complete search history.

(56) References Cited

U.S. PATENT DOCUMENTS

| | | | | | |
|---|---|---|---|---|---|
| 4,591,485 | A * | 5/1986 | Olsen et al. | ..... | 422/20 |
| 4,767,064 | A * | 8/1988 | Resch | ..... | 241/21 |
| 5,020,731 | A * | 6/1991 | Somoza et al. | ..... | 241/1 |
| 5,025,632 | A * | 6/1991 | Spritzer | ..... | 62/64 |
| 5,035,363 | A * | 7/1991 | Somoza | ..... | 241/1 |
| 5,735,709 | A * | 4/1998 | Hashiguchi et al. | ..... | 439/495 |
| 6,290,778 | B1 * | 9/2001 | Zugibe | ..... | 134/1 |
| 6,336,976 | B1 * | 1/2002 | Usui | ..... | 134/1 |
| 6,669,122 | B2 * | 12/2003 | Kaully et al. | ..... | 241/1 |
| 2002/0069893 | A1 * | 6/2002 | Kawazoe | ..... | 134/1 |
| 2002/0189633 | A1 * | 12/2002 | Powers et al. | ..... | 134/1 |
| 2003/0150476 | A1 * | 8/2003 | Suzuki | ..... | 134/1 |
| 2003/0221701 | A1 * | 12/2003 | Hardwicke et al. | ..... | 134/1 |

* cited by examiner

*Primary Examiner*—Sharidan Carrillo
(74) *Attorney, Agent, or Firm*—Philip D. Askenazy; Peacock Myers, P.C.

(57) ABSTRACT

A method and apparatus for removing solid or semi-solid material from within a container, for example removing an energetic material from the casing of an explosive shell. The method is applicable to the demilitarization of aged or obsolete explosive ordnance, for example mortar rounds, and uses ultrasonic energy rather than heat like previous methods. An item to be demilitarized and cleaned is immersed in a fluid contained within a vessel. An ultrasonic probe or wand is inserted into the submerged item, in proximity with the material to be removed. The fluid is the medium for transmitting sonic energy from the probe to the material to fracture and mobilize the material. Mobilized particulates are expelled from the casing, and settle to the bottom of the fluid vessel for collection. At the conclusion of the process, the emptied container shell, now relatively clean, is retrieved from the vessel and salvaged as desired.

33 Claims, 4 Drawing Sheets

ULTRASONIC REMOVAL OF MATERIALS FROM CONTAINERS

GOVERNMENT RIGHTS

The U.S. Government has a paid-up license in this invention and the right in limited circumstances to require the patent owner to license others on reasonable terms as provided for by the terms of Contract No. W15QKN-04-C-1004, awarded by the United States Department of Defense.

BACKGROUND OF THE INVENTION

1. Field of the Invention (Technical Field)

The present invention relates to cleaning methods and apparatus, particularly methods for cleaning the interior of a container, and more specifically to an ultrasonic apparatus and method for removing energetic materials from explosive munitions intended for demilitarization.

2. Background Art

Changing military needs have resulted in changes to the types and quantities of conventional explosive munitions stored by the United States of America and other nations. More significantly, large quantities of munitions previously retained in military stockpiles currently are nearing the end of their useful or reliable lives. Accordingly, there is a rising demand for rapid, safe, and cost-effective methods for removing the energetic substances from within the casings of aged or obsolete ordnance.

The autoclave approach is the principal method currently employed for demilitarizing munitions. Simply described, the autoclave method involves the heating of the munitions to melt the energetic material. Typically, a munitions casing is held in an inverted position (i.e., with a casing opening disposed downward) and subjected to one or more jets of hot steam to heat the casing (and its contents) above the melting point of the energetic material. As the contained energetic material is heated above its melting point, it undergoes a phase shift from solid or semi-solid to liquid, and the melted material is permitted to flow from the casing into a suitable disposal container or system.

Though commonly employed, the autoclave method for demilitarizing explosive ordnance suffers from several drawbacks. The method cannot be used at all to remove energetic materials having high melting points. The method is energy intensive, requiring as it does the heating of large quantities of water to generate hot steam. Also, the autoclave method is quite slow; the cycle time to heat, drain, and cool a single ammunition item is substantial, thereby decreasing efficiency and increasing overall processing costs. Most importantly, the autoclave method generates significant volumes of toxic vapors that must be controlled; workers employing the method must be safeguarded against exposure to the emitted vapors.

Aging stockpiles around the world are giving rise to an increasing need for a safe and efficient mode of demilitarizing munitions. The present invention meets this rising but unmet need.

SUMMARY OF THE INVENTION

Disclosure of the Invention

The invention is related to using ultrasonic energy to clean material from containers, especially to remove explosive materials from decommissioned military ordnance shells or other explosive ordnance.

The present invention is a method for removing solid or semi-solid material, such as an energetic material, from within a container, for example, the casing of an explosive shell. The material may be caked or agglomerated on the inside surface of the container. The method of the disclosure is readily applied to the demilitarization of aged or obsolete explosive ordnance, for example mortar rounds. Energetic material must be removed safely and efficiently from within the shell casings of munitions destined for disposal.

By this method, ultrasonic energy, rather than heat, is used to remove explosive substances from munitions interiors. An item to be demilitarized and cleaned is immersed in a fluid contained within a vessel. An ultrasonic probe or wand is inserted into the submerged item, in proximity with the material to be removed. The fluid is the medium for transmitting sonic energy from the probe to the material to fracture and mobilize the material. The liquid medium allows coupling of the ultrasonic output with the solid energetic material. The appropriate liquid medium also facilitates the movement and removal of resulting granulated energetic material from the container or munition, and prevents overheating of the energetic material. Mobilized particulates are expelled from the casing, and may be allowed to settle to the bottom of the fluid vessel for collection. At the conclusion of the process, the emptied container shell, now relatively clean, is retrieved from the vessel and salvaged as desired.

The present invention comprises a method for removing material from within a container, the method comprising the steps of immersing the container in fluid, inserting a probe into the container so that an end of the probe is disposed proximate to the material, vibrating the probe at an ultrasonic frequency, fracturing the material to form particles, and removing the particles from the container. The container preferably comprises an explosive ordnance casing. The material preferably comprises an energetic material or an explosive material. The fluid is preferably disposed in a vessel, in which case the method preferably further comprises the step of collecting the particles after they have sunk by gravity to the bottom of the vessel. The fluid is optionally flowing, in which case the method preferably further comprises the step of sweeping the particles away from the container in the flowing fluid.

The method preferably further comprises the step of supporting the container, preferably supporting the container in an upright position and/or supporting the container above a bottom of a fluid vessel. The fluid preferably comprises an organic solvent and preferably suppresses deflagration or detonation of an energetic material. The probe preferably comprises a cylindrical rod. The end of the probe preferably comprises one or more circumferential grooves. The method preferably further comprises the step of moving the probe deeper into the container. The vibrating step preferably comprises vibrating the probe axially. The method preferably further comprises the step of inducing cavitation bubbling in the fluid. The method also preferably further comprises the step of agitating the particles sufficiently to eject them from the container and/or the step of forming a cavity within the material.

The present invention is also an apparatus for removing material from within a container, the apparatus comprising a fluid vessel for immersing the container, a support disposed in the vessel for holding the container, a probe, an end of the probe inserted in the container and proximate to the material, and a driver for ultrasonically vibrating the probe. The container preferably comprises an explosive ordnance casing. The material preferably comprises an energetic material or an explosive material. The support preferably holds the container in an upright position and/or above the bottom of the fluid vessel. The support preferably comprises two or more arms for engaging the exterior contour of the container. The probe preferably comprises a cylindrical metallic rod. The probe end preferably comprises one or more circumferential grooves. The driver preferably comprises a sonicator. The apparatus preferably further comprises an actuator for controlling the insertion depth of the probe in the container. At least a portion of the bottom of the vessel is preferably sloped.

The further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying Out the Invention

The present disclosure relates to methods and apparatus for cleaning containers. A method and apparatus is disclosed for removing solid or semi-solid materials from within the interior of a container which is preferably mostly closed. The principal intended application of the method is the cleaning of aging or obsolete munitions. Thus, the "container" may be the shell casing (typically metal) of an item of explosive ordnance, such as a mortar round, howitzer cartridge, land mine, or the like. The material to be removed from the container thus may be an energetic substance, such as any of the various high-explosive nitrogen compounds commonly used in military ordnance since World War II. It will be readily apparent to persons of ordinary skill, however, that the disclosed method may find beneficial use in other fields of endeavor besides munitions demilitarization.

Many nations of the world, including the United States of America, maintain munitions stockpiles for use in times of military conflict. The stockpiling of explosive ordnance is prudent conduct for any country serious about self defense, but such stockpiles demand management and security. Shifting military needs and advances in the arts of explosives and military ordnance have rendered obsolete many types of munitions manufactured years or decades ago. Moreover, the passage of time can cause an unused explosive device to become unreliable or unsafe for use. Accordingly, active management of munitions resources suggests the need to remove aged or obsolete devices from the stockpile. Munitions removed from inventory may be, and often are, disposed of through the obvious expedient of detonating them in a remote location, thus destroying entirely the item of ordnance.

An item of ordnance slated for removal from stock due to age, obsolescence, or some other reason, however, ideally is "demilitarized" and its components reclaimed. Empty shell casings may be salvaged for their metals content. Energetic substances removed from the casings may be recycled into other useful explosive devices, or disposed of using relatively non-hazardous, environmentally acceptable methods.

There is disclosed herein, accordingly, a method and apparatus for recovering energetic material from military ordnance casings. The energetic material is removed from a casing by ultrasonic energy, which breaks up the energetic material, mobilizes it, and permits its collection at the bottom of a vessel for recovery and re-use. However, any material may be removed from a container according to the present invention.

Figure 1:
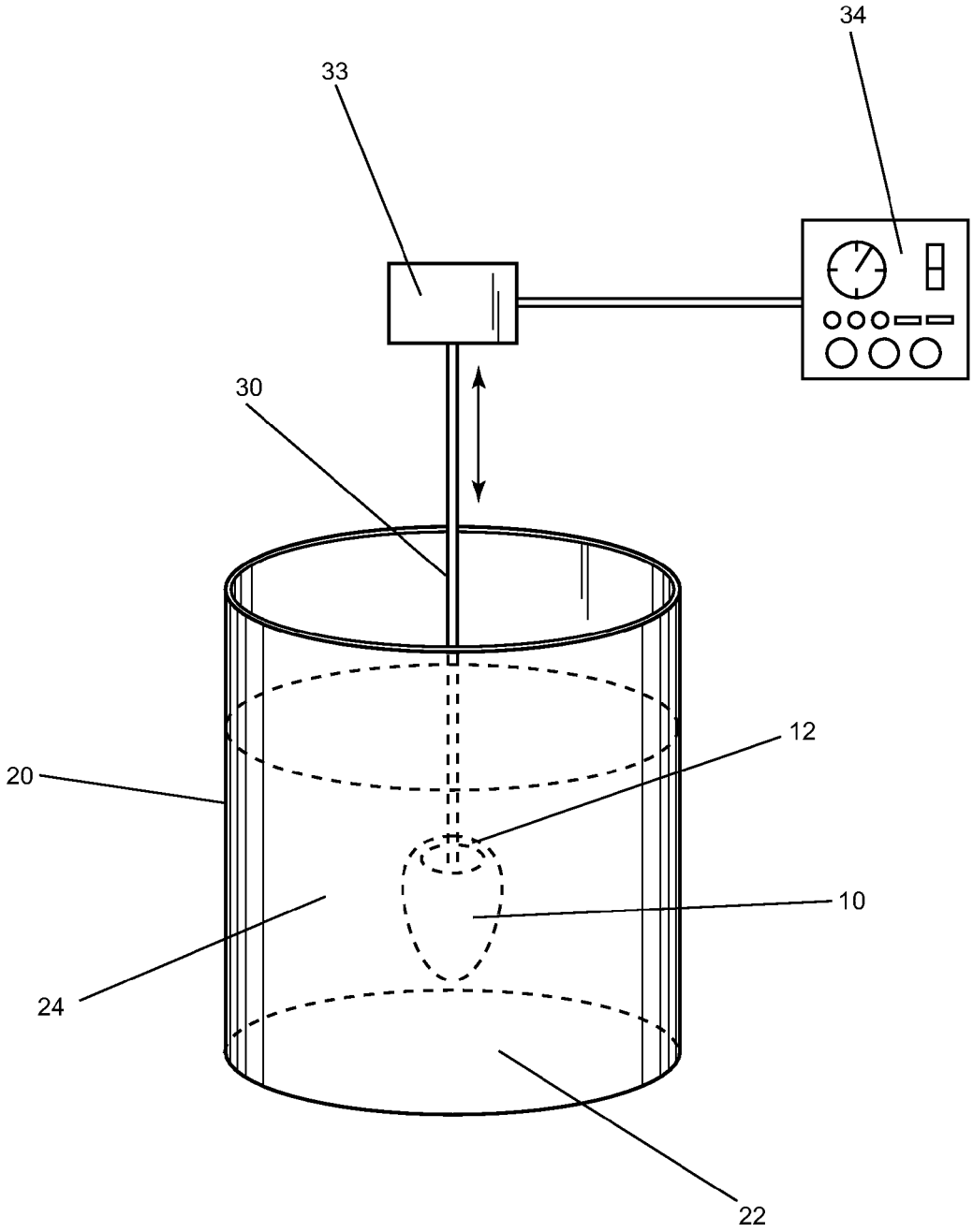
FIG. 1 is a front perspective view of apparatus according to the disclosure, showing a vessel for holding a fluid, in which a container to be cleaned (shown in phantom lines) is immersed during the practice of the invention.

As shown in FIG. 1, material is contained within container 10, which contains a material to be removed, is preferably placed within fluid-filled vessel 20 during the practice of the invention. Vessel 20 preferably has a size sufficient to permit the submersion of at least one container 10 in fluid 24. Vessel 20 may optionally comprise a size and/or shape in order to accommodate the submergence and processing of more than one container 10 at a time. Vessel 20 is shown as cylindrical in FIG. 1 but it may be of any suitable shape. Vessel 20 is preferably fashioned from any corrosion-resistant material, including but not limited to galvanized metal, steel, fiberglass, or any of a number of suitable polymer plastics. Vessel 20 serves as a means for immersing the container 10 in a bath of fluid 24; again, the vessel 20 is preferably filled with fluid 24 of sufficient volume such that the container 10 may be submerged therein.

At the outset of the practice of the invention, container 10 holding the material is preferably lowered into the interior of vessel 20 and immersed in fluid 24, preferably such that the casing is entirely submerged below the surface of the fluid 24. Container 10 preferably is oriented and held within the vessel 20 with container opening 12 facing upward, as seen in FIG. 1. Alternately, the container may be submerged in a flow of suitable fluid.

Figure 1A:
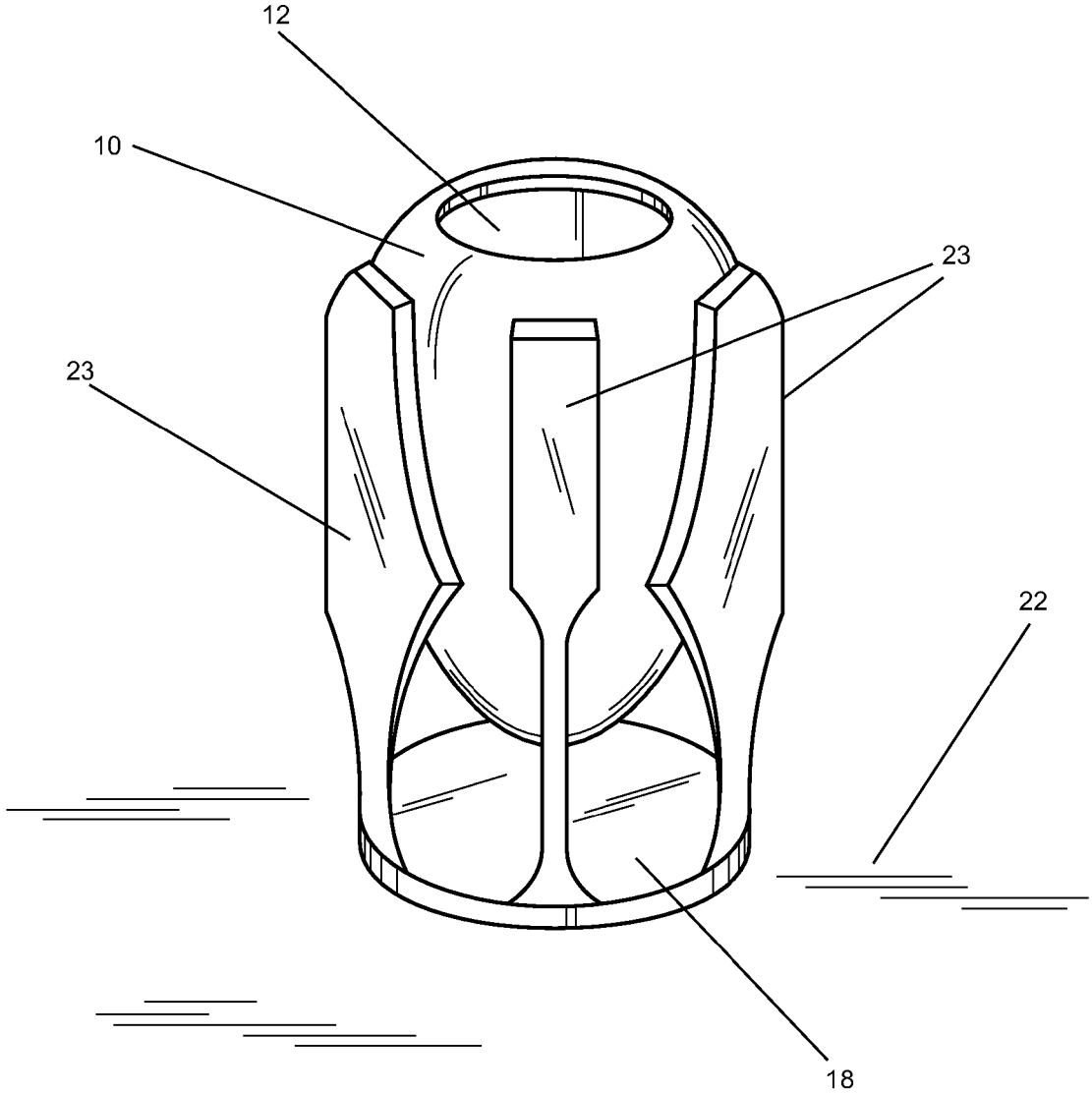
FIG. 1A is a front perspective view, enlarged relative to FIG. 1, of the container to be cleaned held temporarily in a container support (not seen in FIG. 1)

FIG. 1A depicts container support 18 (not depicted in FIG. 1) for temporarily holding container 10 in position within the interior of the vessel. Container 10 preferably rests, preferably by gravity, in any suitably devised or shaped container support 18, which itself rests upon, or may be removably attached to, the interior bottom 22 of vessel 20. Container support 18 may have, for example, two or more arms 23 adapted and shaped to engage the exterior contour of container 10, thereby maintaining the container in an upright position with container opening 12 facing upward. Container support 18 need not have any particular shape; that shown in FIG. 1A is by way of example. The main function of support 18 is to reliably hold the casing in the proper position for the practice of the invention, including, preferably, maintaining the casing a distance spaced above the bottom 22 of the vessel 20.

Container 10 can be of nearly any size, shape or type, and may include that of a shell casing, land mine, mortar round, artillery round, or aerial bomb. In such cases, container opening 12 typically results when the end or nose cap of container 10 is removed to expose material 35 (typically energetic material) contained within the interior of the container. A typical military round treatable according to the disclosed method is, for example, an oblong 81-mm mortar round, which is approximately 8 inches long and about 3 inches in diameter. The casing thereof features a nozzle opening 12 having a diameter of approximately 1.25 inches. Such an opening, provided in ordnance rounds of various types, is preferably the exit through which material 35 is removed from container 10 in the practice of the method.

Fluid 24 preferably has a relatively low surface tension and high vapor pressure. It has been determined that water has too low a vapor pressure for most (but not all) applications, while most oils are too viscous. Fluid 24 preferably comprises an organic solvent, including but not limited to an alcohol, a ketone, or a mixture thereof, and is preferably chosen for maximum efficacy depending on the specific material to be removed. Fluid 24 preferably readily transmits sonic energy, permits limited but desirable cavitation (as explained further herein), reduces heating of the material, and greatly reduces the risk of inadvertent detonation of energetic material. The choice of liquid medium is important to the successful fracturing and removal of material, particularly energetic material. An incorrect medium could lead to deflagration or detonation of the energetic material or, on the other hand, to no significant fracturing of the material. Factors bearing on the selection of the fluid include volatility, boiling point, surface tension, viscosity, density, and solubility of the energetic material.

Figure 2:
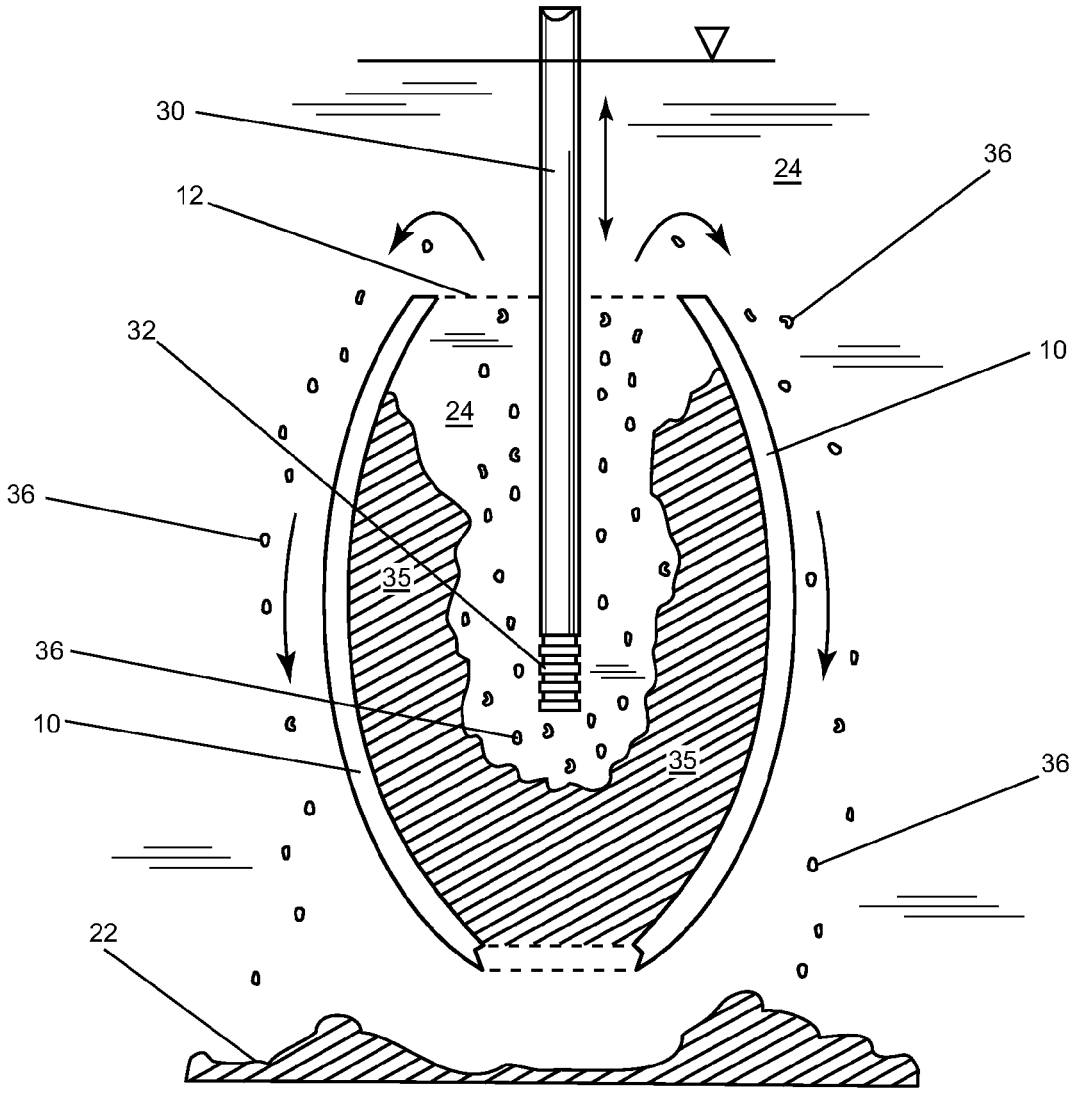
FIG. 2 is a front sectional view of a certain portion of the apparatus seen in FIG. 1, showing the distal end of a probe disposed within a cavity within the container.

As shown in FIGS. 1 and 2, probe 30 is preferably disposed proximate to material 35 within container 10. Probe 30 is preferably capable of vibrating at an ultrasonic frequency in order to fracture and mobilize material 35. Probe 30 preferably comprises a long thin rod having distal end 32 disposed proximate to the energetic material. Probe 30 preferably comprises a titanium alloy and preferably has an axial length adequate to place its distal end 32 adjacent to material 35, while its proximate end is preferably connected to driving or sonicator mechanism 33 situated well above the surface of fluid 24 and preferably operated by controller 34. The shape of probe 30 (particularly its cross-section) can be adapted to situational needs, and need not be limited to a cylindrical rod. Probe 30 and mechanism 33 are preferably connected to an adjustable holder (not shown) of any suitable known configuration which permits the probe to be controllably moved up and down vertically. The body of probe 30 is preferably driven to vibrate at ultrasonic frequencies, preferably between approximately 10 kHz and approximately 30 kHz. This vibration is preferably principally or only axial (i.e., "up and down" in FIGS. 1 and 2), with minimal lateral vibration.

With container 10 immersed in fluid 24 within vessel 20, the probe is controllably lowered until its distal end 32 is very close to the uppermost surface of material 35 within the container. Ordinarily, at the beginning of the method, the uppermost surface of the material will be a planar surface just below container opening 12. As probe 30 vibrates, it fractures and mobilizes the material, and thus effectively bores into it. As the material is mobilized, a cavity develops in the volume of the material, and the probe 30 is preferably lowered at a controllable rate. The probe 30 is moved progressively downward at a rate generally commensurate with the growing size of the developing cavity within the material (and the lowering of the bottom of such cavity). Thus, distal end 32 of the probe 30 preferably continuously remains generally proximate to the energetic material 35, as suggested by FIG. 2.

With distal end 32 lowered into close adjacency with material 35, mechanism 33 is activated to induce vibration, preferably axial, in probe 30. The ultrasonic vibration of distal end 32 results in sonic energy being transmitted to material 35 via fluid 24. The sonic energy (and mechanical energy from micro-bubbling) imparted to material 35 preferably causes it to fracture and spall, with particles 36 of the material being mobilized from the body of material 35. Vibrating probe 30 also preferably causes cavitation bubbling, which cavitation agitates particles 36 mobilizing from the surface of the body of material 35. Such agitation also preferably promotes further mobilization of particles 36, which preferably have a low enough specific gravity so that their agitation and mobilization by the ultrasonically vibrating probe, and the energy being transmitted through the surrounding fluid, results in the lifting of particles 36 from within container 10. Particles 36 preferably exit the container through opening 12, as indicated by directional arrows in FIG. 2.

Once ejected from the container 10, particles 36 are sufficiently separated from the energetic effects of probe 30 that gravity becomes the principle force acting thereon. Thus particles 36 preferably sink by gravity to bottom 22 of vessel 20. The material then can be collected and removed by any appropriate means for recycling or further treatment. For instance, the bottom of vessel 20 optionally may be sloped (e.g., shaped as an inverted cone) and valved to permit material particulates to be drained by gravity. Circulation of the fluid may optionally be employed to improve the performance of the present invention. In the alternate embodiment wherein container 10 is submerged in a flowing stream of fluid, particles 36 are swept away for collection once they have exited opening 12.

Figure 3:
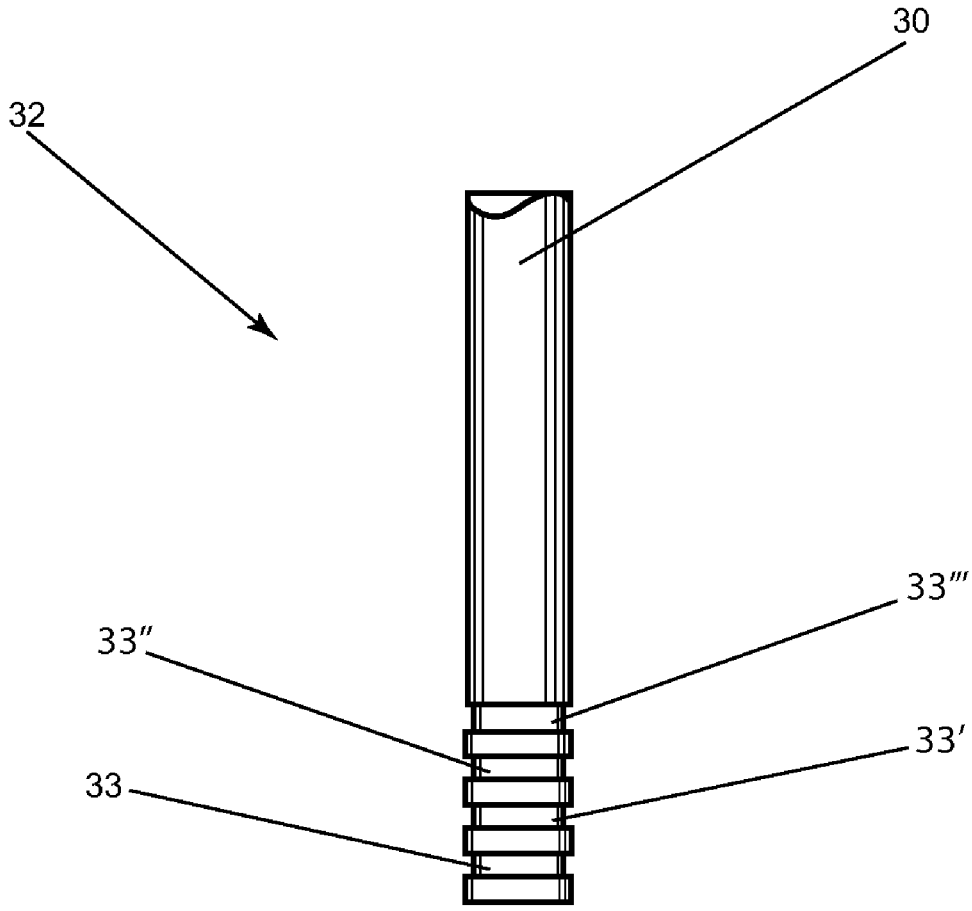
FIG. 3 is a side view of the distal end of the probe element.

As particles 36 are ejected from within container 10, a cavity of increasing size and depth is created within the body of material 35. Probe 30 is lowered at a rate appropriate to maintain the proximity of distal end 32 to the remaining material. The movement of probe 30 may be gradually continuous, or may be incremental, depending in part upon the sophistication of the probe's lowering/raising mechanism (not shown). Ultimately, the cavity within material 35 "bottoms out" at the bottom of the container, at which juncture the downward movement of the probe 30 is stopped. Probe 30 may be maintained in this lowermost position, however, or repeatedly partially retracted and re-lowered within container 10, to promote complete removal of any material 35 that may cling to the insides of the casing. As shown in FIG. 3, distal end 32 preferably comprises one or more, preferably four, circumferential grooves 33, 33', 33", 33'". Such grooves preferably improve the function of axially vibrating probe 30 by promoting cavitation and bubbling to fracture and agitate the material to the sides of probe 30, not just below it. Continued, appropriately controlled operation of ultrasonically vibrating probe 30 preferably results in the fracturing, mobilization, and ejection of substantially all material 35 from within the interior of container 10.

When the cleaning of the interior of the casing is determined to be complete (by timing, or by appropriate inspection methods), probe 30 is raised (for example, manually, mechanically, and/or automatically) from within container 10. Container 10 accordingly has been emptied of energetic material, and is removed from the vessel 20. The next container to be cleaned is then placed in the vessel and immersed in the bath of fluid 24, and the process is repeated.

After inspection, the cleaned casings may lawfully be disposed of in a civilian landfill, although other disposal or re-use may be preferred.

EXAMPLES

The present invention has been successfully used to remove TNT from an 81 mm shell casing, and 3-nitroacetophenone from 60 mm and 81 mm shell casings.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method for removing material from within a container, the method comprising the steps of:

immersing the container in a liquid, the container comprising an explosive ordnance casing;

inserting a probe into the container so that an end of the probe is disposed proximate to the material;

vibrating the probe at an ultrasonic frequency;

fracturing the material to form particles; and removing the particles from the container.

2. The method of claim 1 wherein the material comprises an energetic material.

3. The method of claim 1 wherein the liquid is disposed in a vessel.

4. The method of claim 1 wherein the liquid is flowing.

5. The method of claim 1 further comprising the step of supporting the container.

6. The method of claim 1 wherein the liquid comprises an organic solvent.

7. The method of claim 1 wherein the liquid suppresses deflagration or detonation of an energetic material.

8. The method of claim 1 wherein the probe comprises a cylindrical rod.

9. The method of claim 1 wherein an end of the probe comprises one or more circumferential grooves.

10. The method of claim 1 further comprising the step of moving the probe deeper into the container.

11. The method of claim 1 wherein the vibrating step comprises vibrating the probe in a direction parallel to a primary axis of the probe.

12. The method of claim 1 further comprising the step of inducing cavitation bubbling in the liquid.

13. The method of claim 1 further comprising the step of agitating the particles sufficiently to eject them from the container.

14. The method of claim 1 further comprising the step of forming a cavity within the material.

15. The method of claim 3 further comprising the step of collecting the particles after they have sunk to a bottom of the vessel.

16. The method of claim 4 further comprising the step of sweeping the particles away from the container in the flowing liquid.

17. The method of claim 5 wherein the supporting step comprises supporting the container in an upright position or supporting the container above a bottom of a liquid vessel.

18. A method for removing energetic material from within a container, the method comprising the steps of:

immersing the container in a liquid, the container comprising an explosive ordnance casing;

inserting a probe into the container so that an end of the probe is disposed proximate to the energetic material;

vibrating the probe at an ultrasonic frequency;

fracturing the energetic material to form particles; and removing the particles from the container; wherein the liquid suppresses deflagration or detonation of the energetic material.

19. The method of claim 18 wherein the energetic material comprises an explosive material.

20. The method of claim 18 wherein the liquid is disposed in a vessel.

21. The method of claim 18 wherein the liquid is flowing.

22. The method of claim 18 further comprising the step of supporting the container.

23. The method of claim 18 wherein the liquid comprises an organic solvent.

24. The method of claim 18 wherein the probe comprises a cylindrical rod.

25. The method of claim 18 wherein an end of the probe comprises one or more circumferential grooves.

26. The method of claim 18 further comprising the step of moving the probe deeper into the container.

27. The method of claim 18 wherein the vibrating step comprises vibrating the probe in a direction parallel to a primary axis of the probe.

28. The method of claim 18 further comprising the step of inducing cavitation bubbling in the liquid.

29. The method of claim 18 further comprising the step of agitating the particles sufficiently to eject them from the container.

30. The method of claim 18 further comprising the step of forming a cavity within the material.

31. The method of claim 20 further comprising the step of collecting the particles after they have sunk to a bottom of the vessel.

32. The method of claim 21 further comprising the step of sweeping the particles away from the container in the flowing liquid.

33. The method of claim 22 wherein the supporting step comprises supporting the container in an upright position or supporting the container above a bottom of a liquid vessel.

* * * * *